US011421970B2

(12) United States Patent
Gizowski

(10) Patent No.: US 11,421,970 B2
(45) Date of Patent: Aug. 23, 2022

(54) SPINNING PROJECTILE

(71) Applicant: Frederick Scott Gizowski, Vale, NC (US)

(72) Inventor: Frederick Scott Gizowski, Vale, NC (US)

(73) Assignee: FSG Enterprises, Vale, NC (US)

( * ) Notice: Subject to any disclaimer, the term of this patent is extended or adjusted under 35 U.S.C. 154(b) by 0 days.

(21) Appl. No.: 15/984,791

(22) Filed: May 21, 2018

(65) Prior Publication Data

US 2018/0335285 A1 Nov. 22, 2018

Related U.S. Application Data

(60) Provisional application No. 62/603,244, filed on May 22, 2017.

(51) Int. Cl.

| | |
|---|---|
| ***F42B 10/26*** | (2006.01) |
| ***F42B 10/28*** | (2006.01) |
| ***F42B 12/02*** | (2006.01) |
| ***F42B 30/02*** | (2006.01) |

(52) U.S. Cl.

CPC ..... *F42B 10/28* (2013.01); *F42B 10/26* (2013.01); *F42B 12/02* (2013.01); *F42B 30/02* (2013.01)

(58) Field of Classification Search

CPC ..... F42B 10/00; F42B 10/26; F42B 10/28; F42B 10/38; F42B 12/00; F42B 12/02; F42B 14/00; F42B 14/02; F42B 30/02

USPC ..... 102/439, 501, 516, 517, 524, 526, 525, 102/527, 528; 244/3.23; 42/51; 89/1.3

See application file for complete search history.

(56) References Cited

U.S. PATENT DOCUMENTS

| | | | | | |
|---|---|---|---|---|---|
| 114,807 | A | * | 5/1871 | Hancock | F42B 10/30 244/3.23 |
| 336,556 | A | * | 2/1886 | Douglas | F42B 10/44 244/3.3 |
| 486,657 | A | * | 11/1892 | Ashley | F42B 10/30 244/3.23 |
| 1,442,080 | A | * | 1/1923 | Lyburis | F42B 10/025 244/3.23 |
| 4,016,817 | A | * | 4/1977 | Arciniega Blanco | F42B 7/10 102/519 |
| 4,024,008 | A | * | 5/1977 | Gregornik | B29C 35/08 156/272.4 |
| 4,682,546 | A | * | 7/1987 | Chovich | F42B 8/14 102/501 |
| 4,943,067 | A | | 7/1990 | Saunders | |
| 5,257,809 | A | * | 11/1993 | Carrizosa | F42B 6/08 473/584 |
| 5,269,534 | A | | 12/1993 | Saunders | |
| 5,388,524 | A | * | 2/1995 | Strandli | F42B 8/16 102/506 |
| 5,932,836 | A | * | 8/1999 | White | F42B 10/22 102/529 |

(Continued)

OTHER PUBLICATIONS

U.S. Appl. No. 62/603,244, filed May 22, 2017 titled Spinning Point Bullet.

*Primary Examiner* — Joshua E Rodden

(74) *Attorney, Agent, or Firm* — Middleton Reutlinger

(57) ABSTRACT

A projectile fired from a weapon which has a bore with inner rifling, having a point and a base which are disposed within a sleeve such that the point and base of the projectile rotate independently of the sleeve when fired from a gun or similar weapon designed to discharge projectiles or similar material.

4 Claims, 4 Drawing Sheets

(56) References Cited

U.S. PATENT DOCUMENTS

| | | | | |
|---|---|---|---|---|
| 6,305,293 | B1 * | 10/2001 | Fry | F42B 12/78 102/516 |
| 6,343,553 | B1 * | 2/2002 | O'Dwyer | F41A 21/06 102/438 |
| 6,623,385 | B1 | 9/2003 | Cole | |
| 6,817,299 | B1 * | 11/2004 | Cooke | F42B 12/24 102/493 |
| 7,360,491 | B2 * | 4/2008 | Sanborn | F42B 12/34 102/503 |
| 7,900,561 | B2 * | 3/2011 | Marx | F42B 14/02 102/526 |
| 8,171,852 | B1 * | 5/2012 | Rebar | F42B 12/34 102/509 |
| 8,286,558 | B2 * | 10/2012 | Marx | F42B 14/04 102/527 |
| 9,410,773 | B2 | 8/2016 | Greenwood | |
| 9,593,921 | B1 * | 3/2017 | Kostka | F42B 8/14 |
| 9,644,929 | B1 * | 5/2017 | Bradbury | F42B 10/26 |
| 9,658,036 | B2 | 5/2017 | Zobell | |
| 2006/0027128 | A1 * | 2/2006 | Hober | F42B 14/02 102/514 |
| 2011/0155014 | A1 * | 6/2011 | Marx | F42B 10/26 102/517 |
| 2011/0155016 | A1 * | 6/2011 | Marx | F42B 10/26 102/524 |
| 2018/0216922 | A1 * | 8/2018 | Bucher | F42B 14/06 |
| 2018/0306563 | A1 * | 10/2018 | Lotan | G01S 13/883 |
| 2019/0265007 | A1 | 8/2019 | Gizowski | |

* cited by examiner

SPINNING PROJECTILE

BACKGROUND OF THE INVENTION

1. Field of the Invention

The present invention relates to the field of shooting using projectile weapons. More particularly, the present invention relates to projectile fired from a weapon which comprises a a point and a base which are disposed within a sleeve such that the point and base of the projectile rotate independently of the sleeve when fired from a gun or similar weapon designed to discharge projectiles or similar material.

2. Background of the Invention

A gun is a normally tubular weapon or other device designed to discharge projectiles or other material. The projectile may be solid, liquid, gas or energy and may be free, as with bullets and artillery shells, or captive as with Taser probes and whaling harpoons. The means of projection varies according to design but is usually affected by the action of gas pressure, either produced through the rapid combustion of a propellant or compressed and stored by mechanical means, operating on the projectile inside an open-ended tube in the fashion of a piston. The confined gas accelerates the movable projectile down the length of the tube, imparting sufficient velocity to sustain the projectile's travel once the action of the gas ceases at the end of the tube or muzzle. Alternatively, acceleration via electromagnetic field generation may be employed in which case the tube may be dispensed with and a guide rail substituted.

Most guns use compressed gas confined by the barrel to propel the bullet up to high speed, though devices operating in other ways are sometimes called guns. In firearms the high-pressure gas is generated by combustion, usually of gunpowder. This principle is similar to that of internal combustion engines, except the bullet leaves the barrel, while the piston transfers its motion to other parts and returns down the cylinder. As in an internal combustion engine, the combustion propagates by deflagration rather than by detonation, and the optimal gunpowder, like the optimal motor fuel, is resistant to detonation. This is because much of the energy generated in detonation is in the form of a shock wave, which can propagate from the gas to the solid structure and heat or damage the structure, rather than staying as heat to propel the piston or bullet. The shock wave at such high temperature and pressure is much faster than that of any bullet and would leave the gun as sound either through the barrel or the bullet itself rather than contributing to the bullet's velocity.

Typical guns or similar weaponry comprise a gun barrel. Barrel types can be rifled or smoothbore. Rifled gun barrels have a series of spiraled grooves or angles within the barrel, which results in an induced spin to stabilize the projectile. Smoothbore barrels lack such grooves and are used when the projectile is stabilized by other means or when rifling is undesired or unnecessary. Typically, interior barrel diameter and the associated projectile size is a means to identify gun variations. Bore diameter is reported in several ways. The more conventional measure is reporting the interior diameter (bore) of the barrel in decimal fractions of the inch or in millimeters. Some guns—such as shotguns—report the weapon's gauge, which is the number of shot pellets having the same diameter as the bore produced from one English pound (454 g) of lead) or—as in some British ordnance—the weight of the weapon's usual projectile.

A gun projectile may be a simple, single-piece item like a bullet, a casing containing a payload like a shotshell or explosive shell, or complex projectile like a sub-caliber projectile and sabot. The propellant may be air, an explosive solid, or an explosive liquid. Some variations like the Gyroject and certain other types combine the projectile and propellant into a single item.

For the present invention, the term gun may refer to any sort of projectile weapon from large cannons to small firearms, which include those that are usually hand-held, known as handguns. The use of the term cannon is interchangeable with gun. Autocannons are automatic guns designed primarily to fire shells and are mounted on a vehicle or other mount. Machine guns are similar, but usually designed to fire simple projectiles. The term gun can also comprise military and naval guns which include any large-caliber, direct-fire, high-velocity, flat-trajectory artillery piece employing an explosive-filled hollowed metal shell or a solid bolt as its primary projectile.

Bullets are made of a variety of materials. They are available singly as they would be used in muzzle loading and cap and ball firearms, as part of a paper cartridge, and much more commonly as a component of metallic cartridges. Bullets are made in a large number of styles and constructions depending on how they will be used. Many bullets have specialized functions, such as hunting, target shooting, training, defense, and warfare. A bullet is not a cartridge. In paper and metallic cartridges, a bullet is one component of the cartridge. Bullet sizes are expressed by their weight and diameter in both English and Metric measurement systems. For example: .22 caliber 55 grain bullets or 5.56 mm 55 grain bullets are the same caliber and weight bullet. The bullets used in many cartridges are fired at a muzzle velocity faster than the speed of sound, which is about 343 m/s or 1126 ft/s in dry air at 20° C. or 68° F. This means they are supersonic and thus can travel a substantial distance and even hit a target before a nearby observer hears the shot. Bullet speed through air depends on a number of factors such as barometric pressure, humidity, air temperature, and wind speed.

Bullets are designed to solve two primary problems. In the barrel, they must first form a seal with the gun's bore. If a strong seal is not achieved, gas from the propellant charge leaks past the bullet, thus reducing efficiency and possibly accuracy. The bullet must also engage the rifling without damaging or excessively fouling the gun's bore, and without distorting the bullet, which will also reduce accuracy. Bullets must have a surface that forms this seal without excessive friction. These interactions between bullet and bore are termed internal ballistics. Bullets must be produced to a high standard, as surface imperfections can affect firing accuracy.

The physics affecting the bullet once it leaves the barrel is termed external ballistics. The primary factors affecting the aerodynamics of a bullet in flight are the bullet's shape and the rotation imparted by the rifling of the gun barrel. Rotational forces stabilize the bullet gyroscopically as well as aerodynamically. Any asymmetry in the bullet is largely canceled as it spins. However, a spin rate greater than the optimum value adds more trouble than good, by magnifying the smaller asymmetries or sometimes resulting in the bullet exploding midway in flight.

Generally, bullet shapes and design are a compromise between aerodynamics, interior ballistic necessities, and terminal ballistics requirements. When a bullet contacts its target, the outcome of the impact is determined by the composition and density of the target material, the angle of incidence, and the velocity and physical characteristics of the bullet itself. Bullets are generally designed to penetrate, deform, or break apart. For a given material and bullet, the strike velocity is the primary factor that determines which outcome is achieved.

Bullets can be made of many materials, as the present invention is directed to bullets made from any material known to be used by those skilled in the art to be used to make bullets. Bullets for black powder, or muzzle-loading firearms, were classically molded from pure lead. These work well for low-speed bullets, fired at velocities of less than 450 m/s (1475 ft/s). For slightly higher-speed bullets fired in modern firearms, a harder alloy of lead and tin or similar metals works very well. For even higher-speed bullet use, jacketed coated lead bullets are used. The common element in all of these, lead, is widely used because it is very dense, thereby providing a high amount of mass—and thus, kinetic energy—for a given volume. Lead is also cheap, easy to obtain, easy to work, and melts at a low temperature, which results in comparatively easy fabrication of bullets. Bullets may also incorporate other metals, such as zinc, tin, antimony, and copper, among others. Bullets intended for higher velocities may be made with jacketed lead, which generally means having a lead core that is jacketed or plated with another metal or metal alloy, such as gilding metal, cupronickel, copper alloys, or steel. The thin layer of harder metal protects the softer lead core when the bullet is passing through the barrel and during flight, which allows delivering the bullet intact to the target. There, the heavy lead core delivers its kinetic energy to the target. A full metal jacket or "ball" bullet is completely encased in the harder metal jacket, except for the base. Some bullet jackets do not extend to the front of the bullet, to aid expansion and increase lethality. These are called soft point if the exposed lead tip is solid, or hollow point if a cavity or hole is present. Steel bullets are often plated with copper or other metals for corrosion resistance during long periods of storage. Synthetic jacket materials such as nylon and Teflon are also known in the arts and are used with some success in rifles. Hollow point bullets with plastic aerodynamic tips have been very successful at both improving accuracy and enhancing expansion.

Other bullets are known in the arts and may be encompassed by the present invention. These include:

(1) Blanks, which are wax, paper, plastic, and other materials used to simulate live gunfire and intended only to hold the powder in a blank cartridge and to produce noise, flame and smoke;

(2) Practice bullets, which are made from lightweight materials like rubber, wax, wood, plastic, or lightweight metal, and which are intended for short-range target work only;

(3) Polymer bullets, which are metal-polymer composites, generally lighter and higher velocity than a pure metal bullet of the same dimensions. They permit unusual designs that are difficult with conventional casting or lathing;

(4) Less lethal bullets which may include rubber, plastic, or beanbag bullets;

(5) Incendiary bullets which are made with an explosive or flammable mixture in the tip that is designed to ignite on contact with a target. The intent is to ignite fuel or munitions in the target area, thereby adding to the destructive power of the bullet itself;

(6) Exploding bullets, which are similar to the incendiary bullet, being designed to explode upon hitting a hard surface, preferably the bone of the intended target;

(7) Tracer bullets, which have a hollow back, filled with a flare material, usually a mixture of magnesium metal, a perchlorate, and strontium salts to yield a bright red color. Tracer material burns out after a certain amount of time and is useful to the shooter as a means of learning how to point and shoot at moving targets with rifles. This type of round is also used by all branches of the United States military in combat environments as a signaling device to friendly forces;

(8) Armor-piercing bullets, which are jacketed designs where the core material is a very hard, high-density metal such as tungsten, tungsten carbide, depleted uranium, or steel. A pointed tip is often used, but a flat tip on the penetrator portion is generally more effective;

(9) Nontoxic shot bullets, which comprise nontoxic shot. These bullets are often steel, bismuth, tungsten, or similar alloys which prevent the release of toxic lead into the environment. Regulations in several countries mandate the use of nontoxic projectiles especially when hunting waterfowl;

(10) Blended metal bullets, which are made using cores from powdered metals other than lead with binder;

(11) Frangible bullets, which are designed to disintegrate into tiny particles upon impact to minimize their penetration for reasons of range safety, to limit environmental impact, or to limit the shoot-through danger behind the intended target, and

(12) Multiple point bullets, which are bullets that are made of separate slugs that fit together inside the cartridge, and act as a single projectile inside the barrel as they are fired. The projectiles part in flight but are held in formation by tethers that keep the individual parts of the "bullet" from flying too far away from each other. The intention of such ammo is to increase hit chance by giving a shot like spread to rifled slug firing guns, while maintaining a consistency in shot groupings.

Long range shooters are aware of the effects of gravity, air resistance (drag), and wind on bullet trajectory. There are commercial ballistics programs that can fairly effectively predict trajectories by accounting for the effects of gravity, wind, and drag. However, there are other effects that effect trajectory, including the gyroscopic drift and Coriolis effect.

Gyroscopic drift is the effect of the spin of the projectile. A spinning bullet has a "spin axis" about which it spins. Applying force to the spin axis disturbs the spin, causing the spinning object—the bullet or projectile in this case- to react in a strange way. For a bullet fired at an angle on a long-range trajectory, the bullet starts out with a spin axis aligned with its velocity vector. As the trajectory progresses, gravity accelerates the bullet down, toward the ground. The bullet reacts like a spiraling football by falling into a nose-down torque, but surprisingly with a slight rightward point to follow the initial velocity vector. This slight nose-right flight results in some lateral drift known as gyroscopic drift. Bullets fired from a right twist barrel drift to the right. Bullets fired from a left twist barrel drift to the left. Typical gyroscopic draft for small arms trajectories are about 8-9 inches per 1000 yards. Gyroscopic drift is caused by the interaction of the bullet's mass and aerodynamics with the atmosphere in which it is flying. It depends on the atmospheric properties, not the earth's rotation.

Coriolis Effect, or Coriolis Acceleration, is caused by the fact that the Earth is spinning and is actually dependent on where the shooter is on the planet, and which direction he is shooting. It has horizontal and vertical components. The horizontal component depends on the latitude, i.e., the distance north or south from the equator. Maximum horizontal effect is at the poles, and there is no horizontal effect at the equator. Typically, horizontal Coriolis drift for a small arms trajectory fired near 45 degrees North Latitude is about 2.5-3.0 inches to the right at about 1000 yards. The vertical component of the Coriolis Effect depends on the direction the shooter is firing. Firing due North or South results in zero vertical effect. Firing East causes the trajectory to deflect to result in hitting high. Firing West causes the trajectory to deflect to result in hitting low. The vertical component is maximal at the equator and is zero at the poles. Typically, vertical Coriolis deflection at 45 degrees latitude for a 1000-yard trajectory is about 2.5-3.0 inches high or low, depending on the direction.

All of these effects—gravity, air resistance (drag), wind, gyroscopic drift, and Coriolis effect—can be affected by controlling the spin of the projectile. There is a need for an improved bullet. The flight of prior art bullets is affected by wind resistance acting against them, making it more difficult to effectively hit a target. It is desirable to design a point that does not lose excessive energy due to wind resistance and these other factors, or due to impact with obstructions after hitting a target.

The problem to be corrected is based upon the need for better accuracy in a projectile's trajectory. As currently provided, bullet accuracy is improved on solid projectiles by the internal rifling of the bore. Current solid projectiles must impart spin on the entire mass of the bullet. This adds friction and limits the range of the bullet. The weight limits the battlefield warrior or hunter to the amount of carried ammunition. A spin projectile may be lighter after design refinements as a result of decreased powder charges. Current projectiles have surface contact with the rifling of the barrel along most of the length of the projectile. Reducing the contact surface area to just a portion of the length of the projectile—such as the length of a sleeve on a portion of the projectile—will result in lower friction from the bore rifling. If just such a sleeve is rotated by the rifling, then the sleeve may spin faster than a normal solid projectile. If that sleeve spins faster, it may impart improved ballistic performance or may flatten out the ballistic curve of the projectile.

Moreover, friction from the length of the projectile and powder charges limits sustained firing rates due to the increased generation of heat. By reducing the surface area of to a sleeve portion that is in contact with the bore rifling, there will be a reduction of the heat of the barrel, resulting in a longer sustained firing rate, or improved lifetime of the barrel.

The following patents disclose various improvements in the design of projectiles to improve spin, stability, and accuracy:

U.S. Pat. No. 3,388,696 to Hoverath discloses a magazine and blowpipe for projecting elongate projectiles and which includes a tubular pipe, a magazine, and a plurality of projectiles stored in the magazine and ejected one at a time from a discharge end of the pipe;

U.S. Pat. No. 3,910,579 to Sprandel discloses a swivel action adaptor for securing an arrowhead to the front end of an arrow shaft that includes a bushing that is cemented to the forward end of the arrow shaft and a spindle mounted to the bushing and having a tapered end that is cemented in the socket of the arrowhead;

U.S. Pat. No. 4,175,749 to Simo discloses an arrowhead body for attachment between the nosepiece and the head end of the arrow shaft, and which includes an adaptor having a having a rearward adapter shaft for insertion into the arrow shaft and an opposite forwardly extending adaptor shaft for attachment to the arrowhead body with the adaptor shafts and the adaptor in axial alignment with the arrow shaft and the arrowhead body;

U.S. Pat. No. 4,534,568 to Tone discloses a low frictional rotational element for interconnecting a broad blade arrowhead to the leading end of an arrow shaft, and which includes a housing for permanent installation to the leading end of the arrow shaft and an insert for disposition within the housing, with the insert including annular ridges that serve as low friction bearing surfaces against the inner annular surface of the housing. The insert includes a threaded hole to receive the threaded stud of the arrowhead;

U.S. Pat. No. 4,943,067 to Saunders discloses an arrow insert for a hollow arrow shaft that includes annular alignment rings, an enlarged shoulder, and a glue trap for gluing the insert to the inside annular surface of the arrow so that a field point can be secured to the insert and in position at the front end opening of the shaft of the arrow;

U.S. Pat. No. 5,609,147 to Withorn discloses an arrow thread tracking apparatus for a bow that includes a bolt assembly secured to the bow and a thread attached to the bolt assembly and the arrow for tracking the arrow;

U.S. Pat. No. 5,971,875 to Hill discloses a vaneless arrow shaft that includes a spinner tube having spiral grooves that is placed within the arrow shaft adjacent the nock end, and the arrow shaft having dimples that engage the grooves so that rotation is imparted to the arrow shaft when the bowstring is released for launching the arrow shaft;

U.S. Pat. No. 6,478,700 B2 to Hartman discloses an arrow spin device that includes a screw shaft having cylindrical leading and tailing ends and which is inserted into the arrow shaft so that engagement by, and release from, the bowstring imparts a spin to the arrow without the need for fletching;

U.S. Pat. No. 6,595,880 B2 to Becker discloses a fluted arrow that can be lighter and stronger than standard arrows, and a fluted arrow that has grooves or spirals along its length to impart rotation to the arrow for increased stability and greater velocity;

U.S. Pat. No. 7,207,908 discloses an insert for allowing free rotation of a cutting tip on an arrow shaft, but does not teach or suggest the presently claimed spinning point;

U.S. Pat. No. 3,949,677 to Voss discloses a small caliber projectile with an asymmetrical point which affects the rotation by locating the center of gravity along the projectile's axis of rotation;

U.S. Pat. No. 6,776,101 to Pickard disclose a controlled fragmenting bullet to provide for better distribution of the bullet fragments through an animal's body;

U.S. Pat. No. 4,008,667 to Look discloses a controlled range bullet encompassing a rotary aerodynamic brake that degrades the bullet's lethality after the bullet's trajectory passes a specified distance; and U.S. Pat. No. 6,997,110 to Rastegar discloses a bullet with deployable blades or other portions that deploys prior to impact with a target to increase the footprint of the bullet or decrease the lethality of the bullet for impact with the target.

Nonetheless, despite the ingenuity of the above devices, there remains a need for an improved projectile of all types discussed herein. Differences in the aerodynamics of points and other projectiles renders much of the prior art inapplicable. There is a need for a spinning projectile that allows the tip to freely rotate relative to the body of the projectile, with the spin imparted by the rifling in the barrel of the gun limited to a sleeve around the tip. This will allow more lift and less wind resistance during the flight of the projectile to the target.

BRIEF SUMMARY OF THE INVENTION

It is an object of the present invention to provide a spinning projectile fired from a weapon which comprises a point and a base which are disposed within a sleeve such that the point and base of the projectile rotate independently of the sleeve when fired from a gun or similar weapon designed to discharge projectiles or similar material.

SUMMARY OF THE INVENTION

The present invention comprehends a spinning projectile fired from a weapon which comprises a point and a base which are disposed within a sleeve such that the point and base of the projectile rotate independently of the sleeve when fired from a gun or similar weapon designed to discharge projectiles or similar material. The sleeve spin is imparted by the rifling in the spinning point results in better accuracy, better projectile speed, and better target penetration.

In archery, a spin point for arrows allows the point to spin around a central axis of the arrow. Because the point can spin, it allows the fletchings of the arrow not to have to spin the entire mass of the point, allowing the fletched arrow shaft to spin faster around the non-spinning point, resulting in increased arrow accuracy. While the differences between archery and the shooting sports are substantial, rendering such prior art based on archery largely irrelevant, the inventor has found that a spinning projectile design assembly results in improved projectile characteristics, including a flattened trajectory and increased accuracy with a projectile. This limits the spin to a sleeve part of the assembly. Rather than having the internal rifling of the bore spin the entire mass of a projectile, a spin projectile limits the mass of the spin to a fraction of the mass because only the sleeve is subject to the spin imparted by the rifling in the barrel. The spin imparted to the sleeve part may result in the sleeve spinning faster than the entire mass of the projectile. This is believed to improve the ballistic properties of the projectile or flatten the projectile trajectory. This design is scalable from small pistol and rifle projectiles to multi-centimeter, large-bore delivered projectiles.

In an embodiment of the present invention, the spinning projectile is a mechanical assembly of a Projectile Head 1, a Sleeve 2 and a Base 2, as seen in FIGS. 1-4. The interaction of the spinning projectile with the rifling of the gun barrel is limited to the sleeve portion. Accordingly, the mass of the projectile subject to the spin is limited, allowing the Projectile Head and Base to not spin. It is believed that such a reduction in the mass of the projectile subject to spinning will likely result in an increased projectile, velocity and/or a flattening of the projectile trajectory.

BRIEF DESCRIPTION OF THE DRAWINGS

These and other features of the invention will become more apparent from reference to the attached drawings, inserted herein below.

REFERENCE NUMERALS IN THE DRAWINGS

1. Head
2. Sleeve
3. Base
4. External Threads
5. Internal Threads
6. Point
7. Stem

DETAILED DESCRIPTION OF VARIOUS EMBODIMENTS OF THE INVENTION

Various embodiments of the invention are described more fully hereinafter with reference to the accompanying drawings. Some, but not all, embodiments of the invention are shown in the figures. Indeed, the disclosed invention may be embodied in many different forms and should not be construed as limited to the embodiments set forth herein. Rather, these embodiments are provided as examples, and so that this disclosure will satisfy legal requirements.

Figure 1:
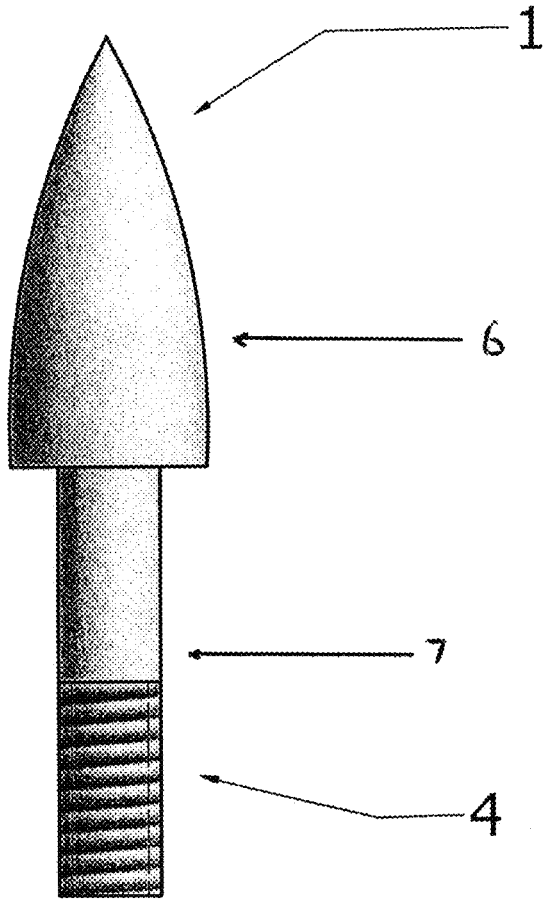
FIG. 1 is a drawing of the head component of the present invention.
Figure 2:
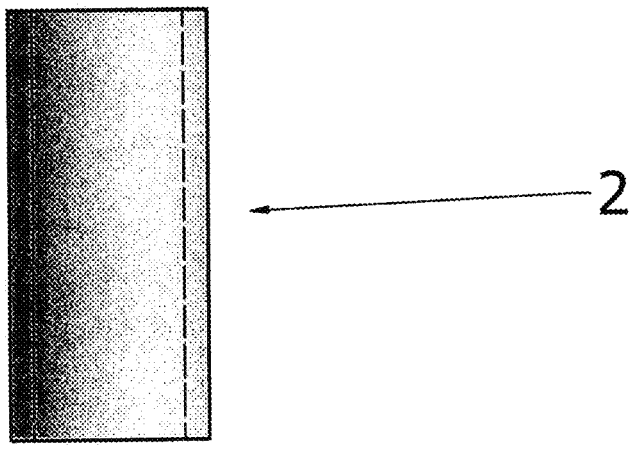
FIG. 2 is a drawing of the sleeve component of the present invention.
Figure 3:
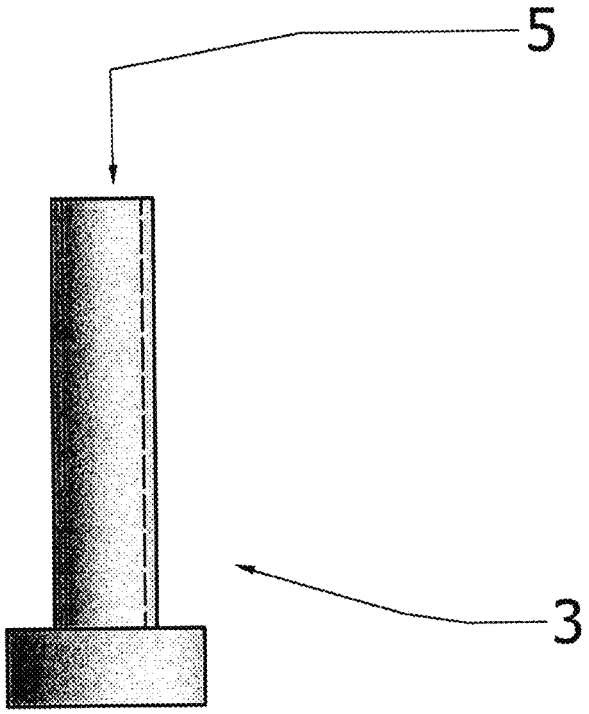
FIG. 3 is a drawing of the base component of the present invention.

FIGS. 1-3 show the parts and assembly for an example of a 9 mm projectile. It is understood that the same principles can be applied to substantially any size projectile fired by a gun or similar device.

FIG. 1 shows the head 1 of the spinning projectile of the present invention.

FIG. 2 shows the sleeve component 2 of the present invention.

FIG. 3 shows the base component 3 of the present invention.

Figure 4:
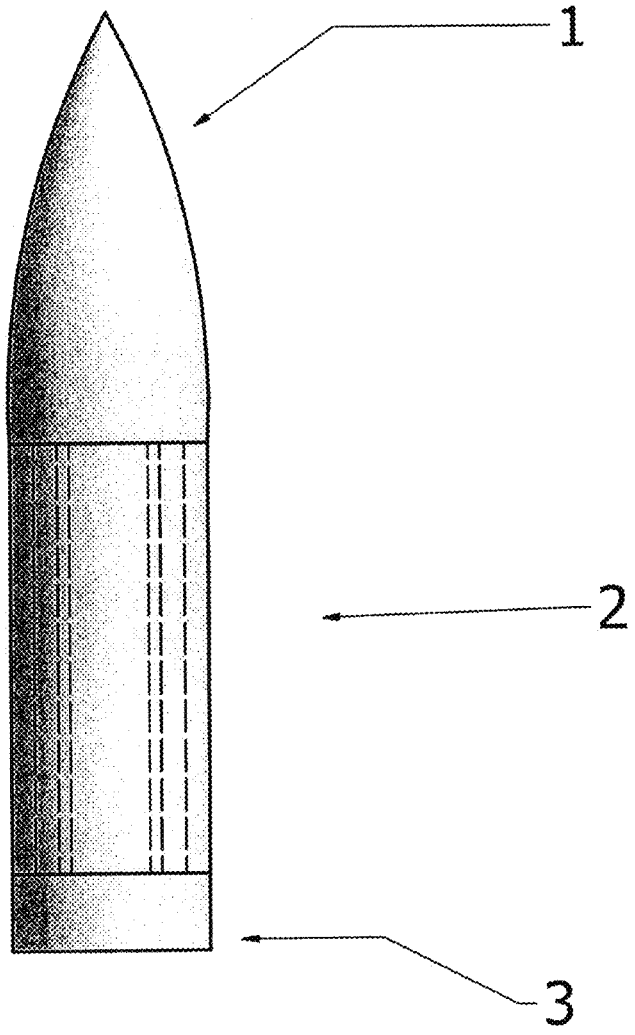
FIG. 4 is a drawing of the assembled projectile of the present invention.

FIG. 4 shows a drawing of the prototype spin projectile design. The diameter of the Head 1 and the Base 3 are slightly smaller than the Sleeve 2 diameter such that the bore rifling is only in contact with the Sleeve diameter.

With the present innovative improvement, the spinning projectile should provide the following benefits as compared to a solid projectile in which the entire projectile is subject to spinning:

(1) Flatter trajectory, increased accuracy
(2) Reduced bore friction
(3) Higher sustained rate of fire
(4) Reduced powder charge
(5) Quieter firing for silencers
(6) Extended range of projectile
(7) Increased standoff distance
(8) Scalable design In a preferred embodiment of the present invention, the projectile head 1 and the base 3 are machined to a slightly smaller diameter than the sleeve 2. The sleeve 2 is the only portion of the projectile that engages the bore's inner rifling. The projectile head 1 and base 3 do not engage the rifling and therefore do not spin with the sleeve. As a nonlimiting example, powdered graphite or other lubricants may assist with reducing friction within the assembly. The disclosed spin relationship may increase velocity, reduce internal bore friction, or may flatten the projectile ballistic curve.

In a further preferred embodiment, the head 1 of the spinning projectile of the present invention is manufactured with a substantially pointed portion 6 and a stem 7. In a further preferred embodiment, the stem can comprise external threads 4. The sleeve component 2 is sized to have a diameter slightly larger than the head 1, and the sleeve is placed over the stem of the head 1 to form the projectile of the present invention. The base component 3 comprises internal threads 5 which engage the external threads of the stem of the head portion of the present invention to form the projectile of the present invention. The Head 1 and the Base 3 are slightly smaller than the Sleeve 2 diameter such that the bore rifling is only in contact with the Sleeve diameter.

The projectile design is scalable from a 5.56 caliber, 9 mm bullet, to multi-centimeter diameter projectiles that are bore delivered, such as naval guns, tank rounds, and artillery.

As noted above, the present innovation is believed to have the advantage of reducing the mass of the projectile that must spin. This is believed to reduce any disturbances in ballistics caused by wobbling due to inconsistencies within the projectile itself. Further, by reducing the surface area that contacts the inner bore surface, it is believed that there will be a reduction of projectile friction, and thus a reduction of heat generation that will lead to an increase in the sustained firing rate. The reduction of the friction between the projectile and the bore will also likely result in a reduction in the powder charge needed to fire the projectile. Reducing the powder charge may enhance the ability to provide for better silencing of subsonic rounds for pistols and rifles, putting more rounds on target. Reduced powder charges should also allow for more ammunition to be carried by the battlefield warrior.

In addition to the above benefits, for large-bore diameter projectiles, a spinning projectile design is believed to allow for an extended range for the projectile trajectory, with a concomitant increased range for standoff distance. These benefits should increase safety of the warrior in battlefield conditions.

An embodiment of the present invention is a projectile for discharging from a weapon with a bore having inner rifling. The projectile has a head, a base, and a sleeve. The head and base are disposed within the sleeve, and the sleeve has a diameter larger than the diameter of the head and base. The sleeve can rotate independent of the head and base and is the only portion of the projectile that engages with the inner rifling and is thus the only portion of the projectile that is subject to spinning imparted by the rifling.

Another embodiment of the present invention is a projectile for discharging from a weapon having inner rifling. The projectile has a generally cylindrical body, a generally pointed head attached to an end of the body, and a cylindrical sleeve having a diameter larger than said body and head. The body and head are disposed within the sleeve. The sleeve is rotatable independent of the head and body. The sleeve engages with the inner rifling and is subject to spinning imparted by the rifling.

Another embodiment is a method of firing a weapon. The method comprises aiming a weapon comprising a bore having inner rifling toward a target, and discharging a projectile, comprising a generally cylindrical body, a generally pointed head attached to an end of said body, and a cylindrical sleeve having a diameter larger than said body and head wherein said body and head are disposed within said sleeve.

This summary of the invention does not necessarily describe all features of the invention.

A preferred embodiment of the invention is disclosed herein, and it should be understood that numerous modifications, alterations, and variations are possible and practicable by those skilled in the art while still coming within the spirit of the invention and scope of the invention as set forth in the appended claims. While the foregoing written description and drawings of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed. Moreover, the terms "consisting", "comprising" and other derivatives from the term "comprise" are intended to be open-ended terms that specify the presence of any stated features, elements, steps, or components, and are not intended to preclude the presence or addition of one or more other features, elements, integers, steps, components, or groups thereof. Moreover, Applicants have endeavored in the present specification and drawings to draw attention to certain features of the invention, it should be understood that the Applicant claims protection in respect to any patentable feature or combination of features referred to in the specification or drawings. The drawings are provided to illustrate features of the invention, but the claimed invention is expressly not limited to the illustrated embodiments.

I claim:

1. A projectile for discharging from a weapon with a bore having inner rifling, said projectile comprising a head, a base, and a sleeve, wherein said head is at least partially disposed within said sleeve, said base is exposed and located at an opposite end of said sleeve from said head, and wherein said head comprises a first stem and said base directly engages said first stem within said sleeve, and wherein said head, said base, and said first stem are coaxial and sized such that the head and the base are rotatably dependent upon each other, and are rotationally independent of said sleeve, wherein said sleeve has an inside diameter larger than a diameter of said head and the base, and wherein said sleeve has an outside diameter sized to engage with said inner rifling, wherein, upon discharge from said weapon, only said sleeve engages with said inner rifling, and wherein said sleeve rotates independently of said head and the base and said sleeve rotates subject to spinning imparted by said inner rifling.

2. The projectile of claim 1, wherein said head is manufactured with a substantially pointed portion and said first stem joined together.

3. The projectile of claim 2, wherein said first stem comprises external threads and said base comprises internal threads, and wherein said first stem is threaded with said base.

4. A system comprising:

a weapon with a bore having inner rifling, and a projectile for discharging from said weapon with said bore having said inner rifling, said projectile comprising a head, a base, and a sleeve, said base located at an opposite end of said sleeve from said head, said head having a first stem, said first stem being directly connected with said base within said sleeve, wherein said head is at least partially disposed within said sleeve, and wherein said head and the base are coaxial and sized such that the head and the base are rotatably dependent upon each other, and are rotationally independent of said sleeve, wherein said sleeve has an inside diameter larger than a diameter of said head and the base, and wherein said sleeve has an outside diameter sized to engage with said inner rifling wherein, upon discharge from said weapon, only said sleeve engages with said inner rifling, and wherein said sleeve is rotationally independent of said head and the base, and rotates subject to spinning imparted by said inner rifling relative to said first stem and said base.

* * * * *